US012338603B2

(12) United States Patent
Friesen et al.

(10) Patent No.: US 12,338,603 B2
(45) Date of Patent: Jun. 24, 2025

(54) TOWED EARTH MOVING IMPLEMENT WITH FIXED-WINGED PITCH-ADJUSTABLE BLADE ASSEMBLY

(71) Applicant: Phiber Manufacturing Inc., Crystal City (CA)

(72) Inventors: Derek J. Friesen, Crystal City (CA); Sean D. Chevalier, Crystal City (CA); Harvey G. Bergen, Crystal City (CA)

(73) Assignee: Phiber Manufacturing Inc., Crystal City (CA)

( * ) Notice: Subject to any disclaimer, the term of this patent is extended or adjusted under 35 U.S.C. 154(b) by 830 days.

(21) Appl. No.: 17/513,430

(22) Filed: Oct. 28, 2021

(65) Prior Publication Data

US 2023/0133831 A1 May 4, 2023

(51) Int. Cl.

| | |
|---|---|
| ***E02F 3/76*** | (2006.01) |
| ***E02F 3/815*** | (2006.01) |
| ***E02F 3/84*** | (2006.01) |

(52) U.S. Cl.

CPC ..... *E02F 3/7672* (2013.01); *E02F 3/7677* (2013.01); *E02F 3/8155* (2013.01); *E02F 3/844* (2013.01)

(58) Field of Classification Search

CPC ..... E02F 3/7672; E02F 3/7677; E02F 3/8155; E02F 3/844; E02F 3/7604

See application file for complete search history.

(56) References Cited

U.S. PATENT DOCUMENTS

| | | | | |
|---|---|---|---|---|
| 2,426,847 | A | 9/1947 | Smith | |
| 2,864,181 | A | 12/1958 | Simmons | |
| 3,327,413 | A | 6/1967 | Brinkmeyer et al. | |
| 3,512,589 | A | 5/1970 | Ulrich | |
| 3,724,557 | A | 4/1973 | Boschung | |
| 3,907,041 | A | 9/1975 | Manor | |
| 4,217,962 | A * | 8/1980 | Schaefer | E02F 3/6454 172/197 |
| 4,240,216 | A | 12/1980 | Martel | |

(Continued)

FOREIGN PATENT DOCUMENTS

| | | |
|---|---|---|
| CA | 2742573 | 9/2011 |
| CA | 2854176 | 7/2015 |

*Primary Examiner* — Adam J Behrens
*Assistant Examiner* — Blake E Scoville
(74) *Attorney, Agent, or Firm* — Kyle R Satterthwaite; Ryan W Dupuis; Ade & Company Inc.

(57) ABSTRACT

A towed earth moving implement features a longitudinal pull tongue, a winged blade assembly with a transverse center blade and a pair of angled outer wing blades, and a wheeled frame on which the blade assembly is carried. A pivotal blade-pitch between the pull tongue and the blade assembly defines a transverse blade pitch axis about which the blade is adjustable in pitch-angle relative to the pull tongue. In a pitch-neutral position, working edges of the wing blades reside in a same horizontal working plane as a working edge of the center blade, for ground leveling purposes. In an upwardly pitched position, the working edges of the wing blades reside in forwardly inclined relation to the horizontal working plane, for ditching purposes. In a downwardly-pitched position, the working edges of the wing blades reside in forwardly declined relation to the horizontal reference plane, for crowning purposes.

17 Claims, 6 Drawing Sheets

(56) References Cited

U.S. PATENT DOCUMENTS

| | | | | |
|---|---|---|---|---|
| 4,834,191 | A * | 5/1989 | Vecchio | E02F 3/815 172/784 |
| 4,898,247 | A | 2/1990 | Springfield | |
| 5,289,880 | A | 3/1994 | Barto | |
| 5,890,546 | A | 4/1999 | Kerpash, Sr. et al. | |
| 6,273,198 | B1 | 8/2001 | Bauer et al. | |
| 7,942,209 | B1 | 5/2011 | Volz | |
| 8,732,993 | B2 * | 5/2014 | Hruska | E02F 3/7604 37/372 |
| 8,813,864 | B2 * | 8/2014 | Layton | A01B 63/004 172/311 |
| 10,011,972 | B2 * | 7/2018 | Helmeczi | E02F 3/8155 |
| 10,400,420 | B2 * | 9/2019 | Stonum | E02F 3/844 |
| 12,012,717 | B2 * | 6/2024 | Waldner | E02F 3/844 |
| 2016/0194853 | A1 * | 7/2016 | Sawatsky | E02F 9/024 172/799.5 |
| 2021/0310212 | A1 * | 10/2021 | Waldner | E02F 5/22 |

* cited by examiner

TOWED EARTH MOVING IMPLEMENT WITH FIXED-WINGED PITCH-ADJUSTABLE BLADE ASSEMBLY

FIELD OF THE INVENTION

This application relates generally to the field of earth working equipment, and more particularly to towed earth moving implements.

BACKGROUND

In the agricultural sector, blade-equipped implements towed behind a tractor are known for the purpose of levelling out the soil level in agricultural fields. Earth moving implements of this type are often configured with a pull tongue whose front end connects to the hitch of the tractor for towed forward conveyance of the implement therebehind, a blade assembly attached to a rear end of the pull tongue in a position lying cross-wise thereto to displace earth forwardly during such towed conveyance of the implement, and a wheeled frame on which the blade assembly is carried from therebehind.

One example of an implement of this type is Applicant's Gladiator implement, where the blade assembly has a center blade lying perpendicularly of the pull tongue, and a pair of wing blades affixed to opposing ends of the center blade and angling forwardly and outwardly therefrom in obliquely oriented relationship thereto, with bottom working edges of the three blades lying in a common plane. One set of actuators connected between the blade assembly and a blade-carrying subframe of the wheeled frame is operable to perform angular tilting between blade assembly and the wheeled frame about a transverse axis to raise and lower the blade relative to the ground. Another set of actuators connected between the blade-carrying subframe and a wheel-carrying subframe of the wheeled frame are operable to perform a swivelling action therebetween about a longitudinal roll axis of the implement, allowing either end of the blade assembly to be tilted up or down relative to the other end to laterally tilt the working plane of the blade assembly to follow or impart an angled grade during use of the implement.

While suitable for such leveling and grading operations, it would be desirable to improve upon an implement of this general type in a manner enabling it to perform a wider variety of different ground shaping operations involving creation of more complex ground surface profiles.

SUMMARY OF THE INVENTION

According to one aspect of the invention, there is provided a towed earth moving implement comprising:

- a pull tongue running in a longitudinal direction and configured at a front end thereof with a coupling arrangement for connection to a tow vehicle for pulling of the implement in said longitudinal direction;
- a blade assembly coupled to the pull tongue and comprising:
  - a center blade lying transversely of the longitudinal direction and spanning laterally outward from the pull tongue each of two opposing sides thereof; and
  - a pair of wing blades connected to the center blade at opposing ends thereof on said two opposing sides of the pull tongue and each being oriented in non-parallel relation to the central blade in an orientation angling both forwardly and laterally outward therefrom; and
- a wheeled frame on which said blade assembly is carried for rolling travel over an earthen surface workable by said blade assembly;
- a pivotal blade-pitch connection between the pull tongue and the blade assembly that defines a blade pitch axis lying transversely of the longitudinal direction; and
- at least one blade-pitch actuator operable to adjust a pitch angle of the blade, relative to the pull tongue, about said blade pitch axis.

According to another aspect of the invention, there is provided a towed earth moving implement comprising:

- a pull tongue running in a longitudinal direction and configured at a front end thereof with a coupling arrangement for connection to a tow vehicle for pulling of the implement in said longitudinal direction;
- a blade assembly coupled to the pull tongue and comprising:
  - a center blade lying transversely of the longitudinal direction and spanning laterally outward from the pull tongue each of two opposing sides thereof; and
  - a pair of wing blades connected to the center blade at opposing ends thereof on said two opposing sides of the pull tongue and each being oriented in fixed non-parallel relation to the central blade in a fixed orientation angling both forwardly and laterally outward therefrom; and
- a wheeled frame on which said blade assembly is carried for rolling travel over an earthen surface workable by said blade assembly;
- wherein each of the center and wing blades has a respective bottom working edge, and the blade assembly is movable between at least two of the following three operational positions, in each of which the respective bottom working edge of the center blade resides in a horizontal working plane:
- a pitch-neutral levelling position in which the respective bottom working edges of the wing blades both reside in the same horizontal working plane as the respective working edge of the center blade;
- an upwardly pitched ditching position in which the respective bottom working edges of the wing blades reside in forwardly inclined working planes of forwardly inclined relation to the horizontal working plane; and
- a downwardly-pitched crowning position in which the respective bottom working edges of the wing blades reside in forwardly decline working planes of forwardly declined relation to the horizontal reference plane.

BRIEF DESCRIPTION OF THE DRAWINGS

One embodiment of the invention will now be described in conjunction with the accompanying drawings in which.

DETAILED DESCRIPTION

Figures 1, 2:
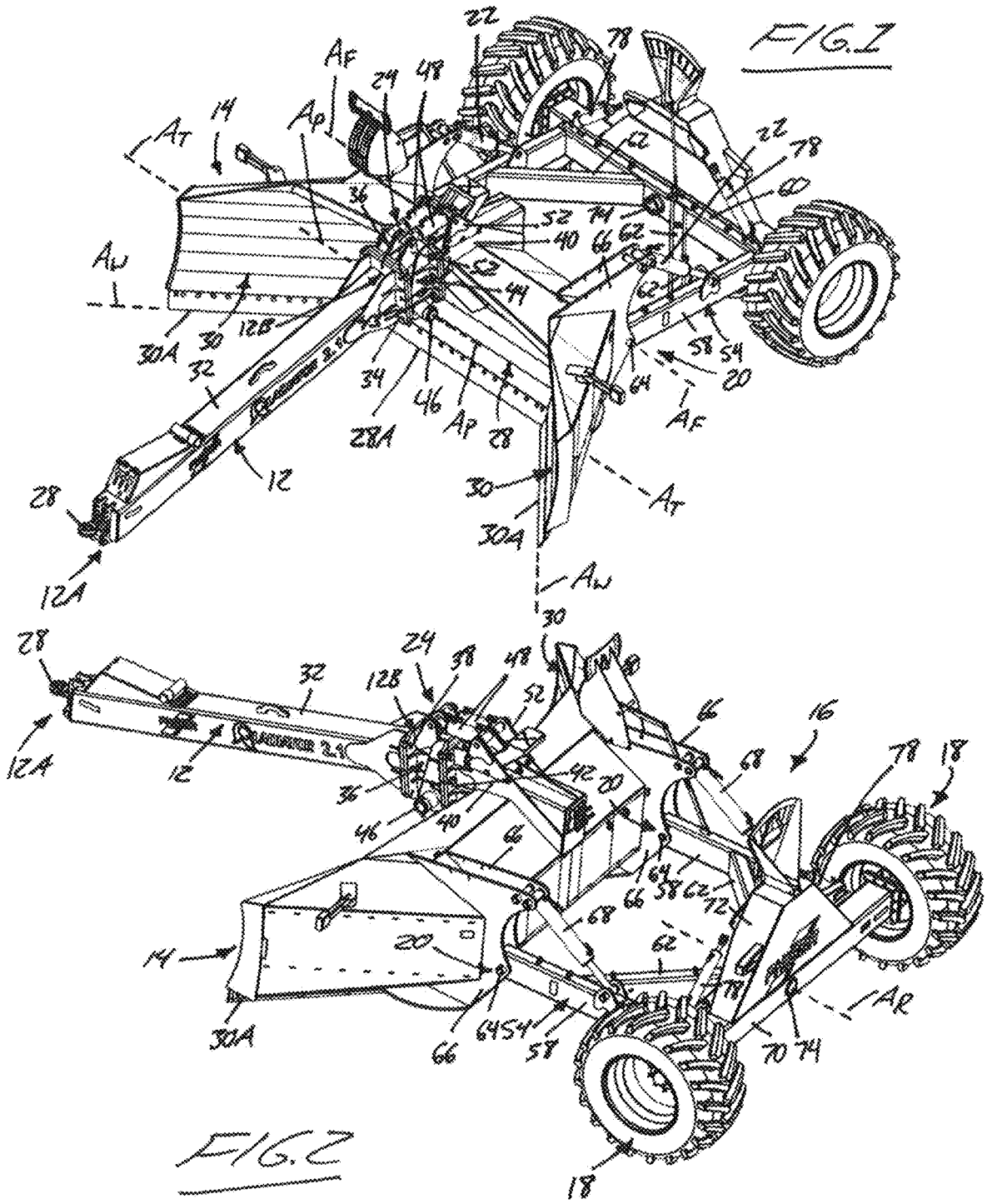
FIG. 1 is a front top left perspective view of a novel earth moving implement of the present invention having a pitch adjustable blade assembly featuring a center blade and two angled wing blades.
FIG. 2 is a rear top left perspective of the implement.

The drawings illustrate a towable earth moving implement 10 of the present invention that includes a winged blade assembly that is of adjustable pitch angle relative to the pull tongue of the implement, and whereby working edges of angled outer wing blades of the blade assembly can be re-oriented between horizontal, forwardly inclined and forwardly declined orientations relative to the working edge of a center blade to whose ends the angled outer wing blades are affixed. As a result, the inventive implement 10 is capable of not only performing the same levelling and grading operations as other towable earth moving implements of the prior art, but is also capable of performing ditching and crowning operations for imparting non-linear profiles to the earthen surface being worked by the implement. The same piece of equipment can thus be used for a larger variety of tasks compared to the prior art.

The implement 10 features a pull tongue 12 for connection to the rear hitch of a tow vehicle (typically a tractor at a front end 12A of the pull tongue, a winged blade assembly 14 connected the pull tongue 12 at a location of rearwardly distal relation to the hitch-connectable front end 12A thereof, and a wheeled frame 16 residing behind the blade assembly 14, and on which the blade assembly 14 is carried for travel of the implement 14 over an agricultural field or other ground area via a set of ground wheels 18 rotatably mounted to the wheeled frame 16.

In similar manner to the prior art, the blade assembly 14 is mounted to a front end of the wheeled frame 16 via a pivotal frame-tilt connection 20, and a pair of frame-tilt actuators 22 are connected between the wheeled frame 16 and the blade assembly for the purpose of adjusting a relative tilt angle between the frame and blade assembly about a frame tilt axis $A_F$ of this connection 20. Adjustment of this tilt angle adjusts an elevation of the blade assembly 14 relative to the ground surface on which the ground wheels 18 reside. The novel implement 10 of the present invention differs from prior in the addition of another degree of freedom to the blade assembly's positional maneuverability, more specifically by novel inclusion of a pivotal blade-pitch connection 24 between the blade assembly 14 and the pull tongue 12, and a corresponding set of one or more blade-pitch actuators 26 operable to adjust a pitch angle of the blade about a blade pitch axis $A_P$ of this connection 24. More details concerning these pivotal connections of the blade assembly 14 to the wheeled frame 16 and pull tongue 12 are given herein further below, after first setting forth other constructional details of the implement 10 for context.

Figure 3:
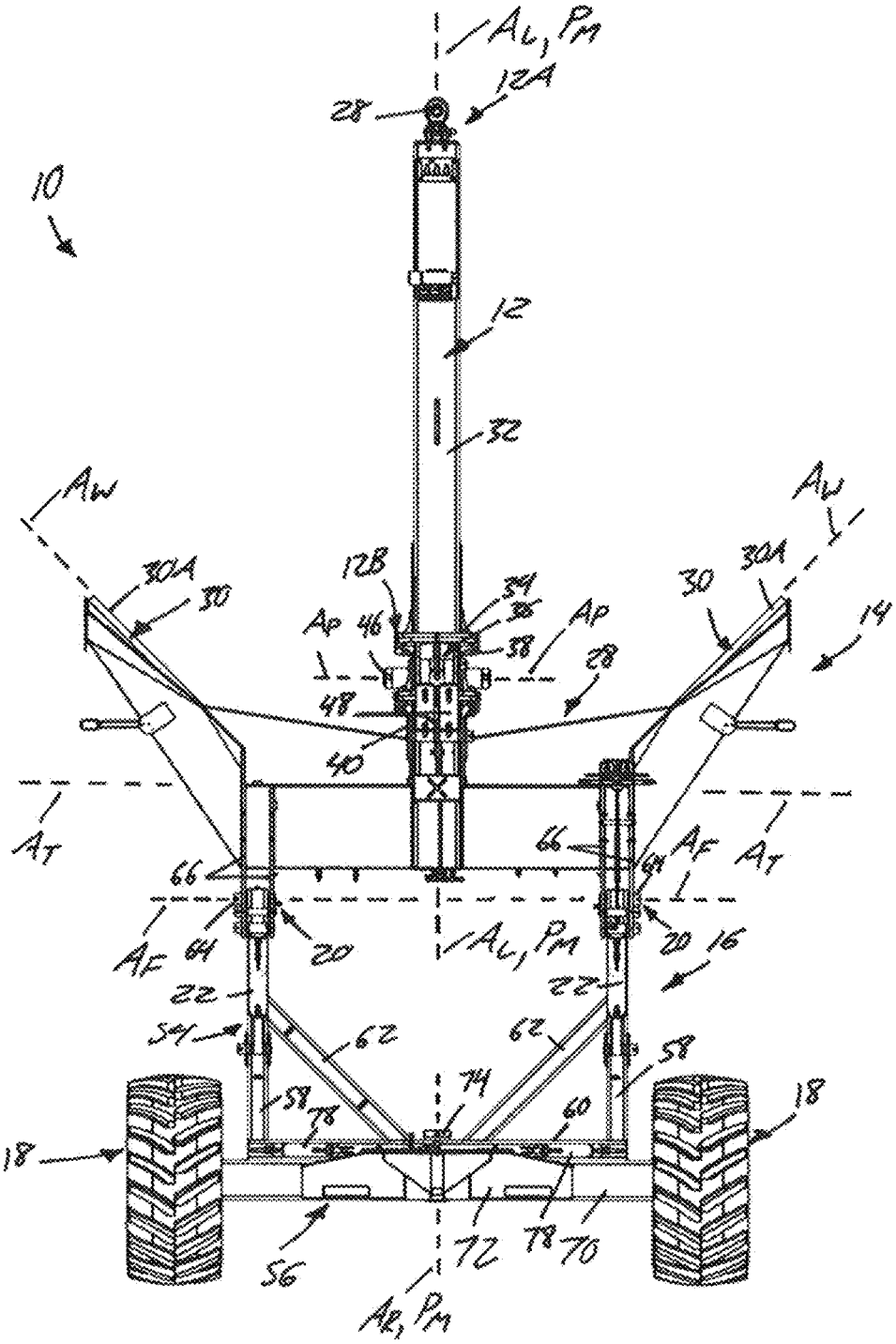
FIG. 3 is a top plan view of the implement.

With reference to the overhead plan view of FIG. 3, this vantagepoint is used as a horizontal reference plane in which orthogonally related longitudinal and transverse/lateral directions are defined to describe relative positions and orientations of various components. The pull tongue 12 runs in a longitudinal direction denoted by longitudinal axis $A_L$. The blade assembly 14 features a center blade 28 that lies perpendicularly transverse of the pull tongue 12 and longitudinal axis $A_L$, as can be seen with reference to a transverse axis $A_T$ that is occupied by a bottom working edge 28A of the center blade 28 and lies horizontally perpendicular of the longitudinal axis $A_L$. The center blade thus extends laterally outward from both sides of the pull tongue 12 in this transverse direction of axis $A_T$. The blade assembly 14 also includes a pair of wing blades 30 that are respectively attached to the opposing ends of the center blade 28 on these opposing sides of the pull tongue 12. Each wing blade 30 is fixed in stationary relation to the center blade 28 in non-parallel relation thereto, and more specifically at an obliquely angled orientation sweeping forwardly and laterally outward from the respective end of the center blade 28, as can be seen with reference to a pair of angled wing axes $A_W$ that are each occupied by a bottom working edge 30A of a respective one of the wing blades. The wing axes $A_W$ are obliquely angled relative to both the longitudinal axis $A_L$ and the transverse axis $A_T$, and are of forwardly divergent relation to one another and symmetric relation to one another across the longitudinal axis $A_L$. The bottom working edges 28A, 30A of the center and wing blades 28, 30 all reside in coplanar relation to one another.

For connection to the tow vehicle (not shown), the front end 12A of the pull tongue 12 features a suitable hitch coupling arrangement 28, which may of conventional design, and therefore is not described herein in any notable detail. A rear end 12B of the pull tongue lies longitudinally opposite of the front end 12A, and resides in front of the center blade 28 of the blade assembly 14. Whereas the rear end 12B of the pull tongue 12 would be rigidly affixed to the blade assembly 14 in the prior art, the rear end 12B of the pull tongue 12 in the present invention is instead movably coupled to the blade assembly 14 via the pivotal blade-pitch connection 24. The pull tongue 12 comprises a main tube 32 spanning longitudinally from the front end 12A of the pull tongue 12 to the opposing rear end 12B thereof. At the rear end 12B, the pull tongue 12 has a first mounting flange 34 that radiates outward from the main tube 32 around the circumference thereof for bolted receipt of a first knuckle assembly 36 ("first knuckle", for brevity) that has a mating fastening flange 38 abutted flush against the mounting flange 34 of the pull tongue. Fixed atop the center blade 28 of the blade assembly 14, and atop an upper hood of the blade assembly 14 that spans forwardly from the top end of the center blade 28 and laterally between the two wing blades 30, is a neck structure 40 ("neck", for brevity) that juts a short distance forwardly from a top end of the center blade 28 at a midpoint thereacross, i.e. at a central midplane of the implement that coincides with the longitudinal axis AL and longitudinally bisects the implement 10. A front end of the neck 40 thus resides a short distance longitudinally forward of the center blade 28, and has mounted thereon a second mounting flange 42 to which a second fastening flange 43 of a second knuckle assembly 44 ("second knuckle", for brevity) is bolted in flush relation thereagainst, just like the bolted attachment of the first knuckle to the first mounting flange on the main tube 32 of the pull tongue 12. The two knuckles 36, 44 reside in nested or intermeshed relation to one another, and are interconnected in pivotably hinged fashion by a pivot shaft 46 that penetrates transversely through the two knuckles. The pivot shaft 46 defines the blade-pitch axis $A_P$, which is of parallel relation to the center blade 28, and to the transverse axis $A_T$ occupied by the bottom working edge 28A thereof, and is of perpendicular relationship to the longitudinal axis $A_L$. The knuckles 36, 44 and cooperating pivot shaft 46 thus collectively form the pivotal blade pitch connection 24 between the blade assembly 14 and the pull tongue 12, by which a pitch angle of the blade relative to the pull tongue 12 can be varied about the blade-pitch axis $A_P$.

In the illustrated example, in relation to width dimensions of the knuckles measured in the transverse direction of the implement, the first knuckle 36 on the pull tongue 12 is of narrower construction than the second knuckle assembly 44 on the neck 40 of the blade assembly. Accordingly, the narrower first knuckle 36 is received in nested fashion between side walls of the wider second knuckle 44, though the nested relationship between the two knuckles may alternatively be reversed. The pivot shaft 46 penetrates through the two knuckles 36, 44 at lower regions thereof. To effect pivotal movement between the blade assembly 14 and the pull tongue 12 about the blade-pitch axis $A_P$, a set of one or more blade-pitch actuators 48 are connected between the pull tongue 12 and the blade assembly 14. The illustrated example features a pair of blade-pitch actuators 48 disposed in closely adjacent and symmetric relationship to one another across the longitudinal axis $A_L$ at a location of overhead relation to the pivot shaft 46. Each blade-pitch actuator 48 has one end pivotably pinned between a first set of connection lugs 50 that are rigidly mounted atop the first knuckle 36, and another end pivotally pinned between a second set of connection lugs 52 that are rigidly mounted atop the neck 40 of the center blade 28. The two blade-pitch actuators 48 are installed in hydraulically parallel relationship to one another for synchronous operation thereof, whereby extension and collapse of these actuators 48 in concert with one another is operable to pitch the blade assembly 14 in opposing directions about the blade-pitch axis $A_P$ relative to the pull tongue 12.

The wheeled frame 16 is composed of two distinct subframes, namely a front blade-carrying subframe 54 and a rear wheel-carrying subframe 56. The blade-carrying subframe 54 is composed of a pair of longitudinal beams 58 lying parallel to one another and to the longitudinal axis $A_L$ in symmetrically disposed positions on opposing sides thereof, a rear cross-beam 60 that perpendicularly interconnects to the two longitudinal beams 58 at rear ends thereof, and a pair of diagonal reinforcement braces 62 that each span internally and diagonally between the rear cross-beam 60 and a respective one of the longitudinal beams 58 on a respective side of the longitudinal axis $A_L$. At a front end of the wheeled frame 16, each longitudinal beam 58 is pivotably coupled to the blade assembly 14 via a respective pivot pin 64. The pivot pin 64 penetrates transversely through a front end of the longitudinal beam 58, and also through a cooperating pair of lug walls 66 that are affixed to the rear of the blade assembly 14 near a respective end of the center blade 28, and between which the front end of the respective longitudinal beam 58 is received. The respective pivot pins 64 of the two longitudinal beams 58 are axially aligned with one another, and define a frame-tilt axis $A_F$ of parallel relationship to the blade-pitch axis $A_P$.

A respective frame-tilt actuator 22 is provided atop each longitudinal beam 58 of the blade-carrying subframe 54, each having a frame-connected end pivotably pinned to the respective longitudinal beam 58 and an opposing blade-connected end pivotably pinned to the blade assembly 14 at points of elevated relation to the frame-tilt axis $A_F$. In the illustrated example, the blade-connected end of each frame-tilt actuator 22 is pinned to the same pair of lug walls 66 between which the front end of the respective longitudinal beam 58 is received, but a higher location thereon. The two frame-tilt actuators 22 are installed in hydraulically parallel relationship to one another for synchronous operation thereof, whereby extension and collapse of these actuators 68 in concert with one another is operable to raise and lower the blade assembly 14 relative to ground level by varying a relative tilt-angle between the blade assembly 14 and the wheeled frame 16 about the frame-tilt axis $A_F$.

The wheel-carrying sub-frame 56 is composed of an axle beam 70 that resides behind the rear cross-beam 60 of the blade-carrying subframe 54, and an upright stanchion 72 mounted atop the axle beam 70. The stanchion 72 resides at a centered location between the opposing ends of the axle beam 70, at which the ground wheels 18 are respectively mounted in rotatable fashion. The axle beam 70 is coupled to the rear cross-beam 60 of the blade-carrying subframe 54 by a swivel connection 74 that resides at the longitudinal midplane $P_M$ of the implement, and thus is located centrally of both the rear cross-beam 60 and axle beam 70. The swivel connection 74 defines a longitudinally-oriented roll-axis $A_R$ that resides in the longitudinal midplane $P_M$ and lies parallel to the longitudinal beams 58 and perpendicular to the frame-tilt axis $A_F$, and about which blade-carrying and wheel-carrying subframes 54, 56 can be swivelled relative to one another. To control relative motion between the subframes 54, 56 about this roll axis $A_R$, a pair of swivel actuators 78 reside on opposing sides of the wheel axle stanchion 72, and each have one end pivotally pinned to the rear cross-beam 60 of the blade-carrying subframe 54 near a respective end of the rear cross-beam 60 thereof, and another end pivotally pinned to the wheel axle stanchion 72 at a nearest side thereof.

By collapsing a selected one of the swivel actuators 78 and simultaneously extending the other, the pair of swivel actuators 78 are operable to perform swivelling of the front blade-carrying subframe 54, and the blade assembly 14 attached thereto, in either direction about the roll axis $A_R$. Such swiveling movement in either direction about the roll axis $A_R$ raises one end of the blade assembly 14 (i.e. one of the wing blades 30), and lowers the other end of the blade assembly 14 (i.e. the other one of the wing blades 30). In a neutral state of both swivel actuators 78 (neither fully collapsed, nor fully extended), the bottom working edge 28A of the center blade 28 of the blade assembly 14 is parallel to the axle beam 70, and thus parallel to the wheel axes and to a ground contact plane in which the ground wheels 18 contact the underlying ground surface, whereby the working edge 28A of the center blade 28 acts to level out the ground surface at its existing grade during towed travel of the implement 10 over the ground. With either swivel actuator 78 extended and the other one retracted, one end of the blade assembly 14 is raised relative to the other, and so the bottom working edge 28A of the center blade 28 of the blade assembly 14 is obliquely tilted about the roll axis $A_R$ relative to the axle beam 70, and thus also obliquely tilted relative to the wheel axes and ground contact plane, whereby towed travel of the implement instead imparts a newly angled grade to the ground surface.

Such adjustment of the blade assembly about a roll axis $A_R$ between a neutral non-tilted roll position, for ground leveling operations, and one of two available tilted roll positions, for grading operations; and relative movement between the wheeled frame 16 and blade assembly 14 about a frame tilt axis $A_F$ to adjust the elevation of the blade assembly 14, are already known in the art, for example as evidenced by Applicant's aforementioned Gladiator implement. However, the novel addition of the blade-pitch connection 24 between the pull tongue 12 and the blade assembly 14, and the associated blade-pitch actuators 48 for adjusting the blade assembly's pitch angle relative to the tongue 12 about the blade pitch axis $A_P$, enables greater variation of the blade assembly's orientation in a beneficial manner enabling more complex ground-shaping operations than the conventional leveling and grading operations achievable by adjustment of the blade's roll-position about the roll axis $A_R$. Different attainable blade assembly positions of varying pitch angle are shown in FIGS. 4A-4C, in each of which the swivel actuators 78 are in their neutral position, corresponding to a roll-neutral position of the blade.

Figure 4A:
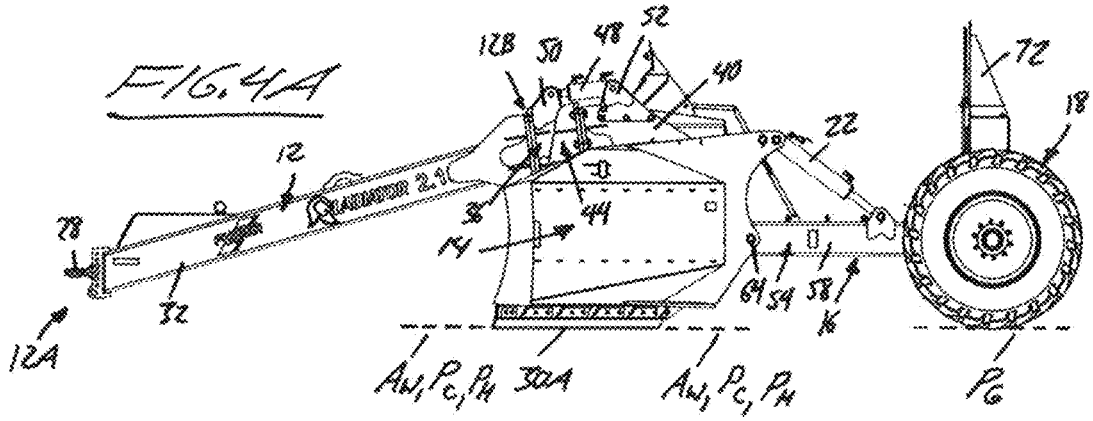
FIG. 4A is a side elevational view of the implement with the blade assembly in a non-pitched position placing working edges of the center and wing blades in a common horizontal working plane to perform a leveling operation on a ground surface.
Figure 5A:
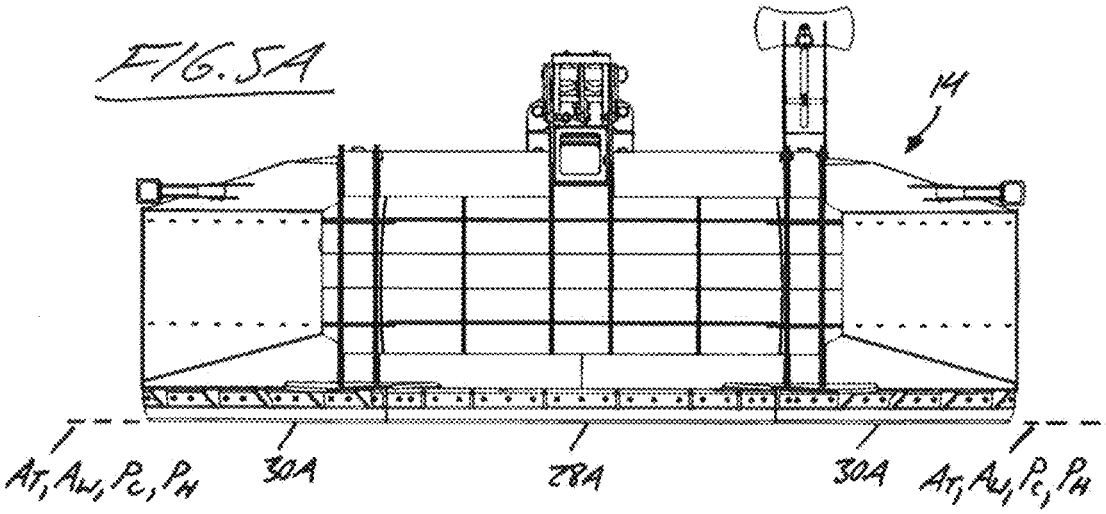
FIG. 5A is a rear elevational view of the blade assembly of the implement in the non-pitched position of FIG. 4A.
Figure 6A:
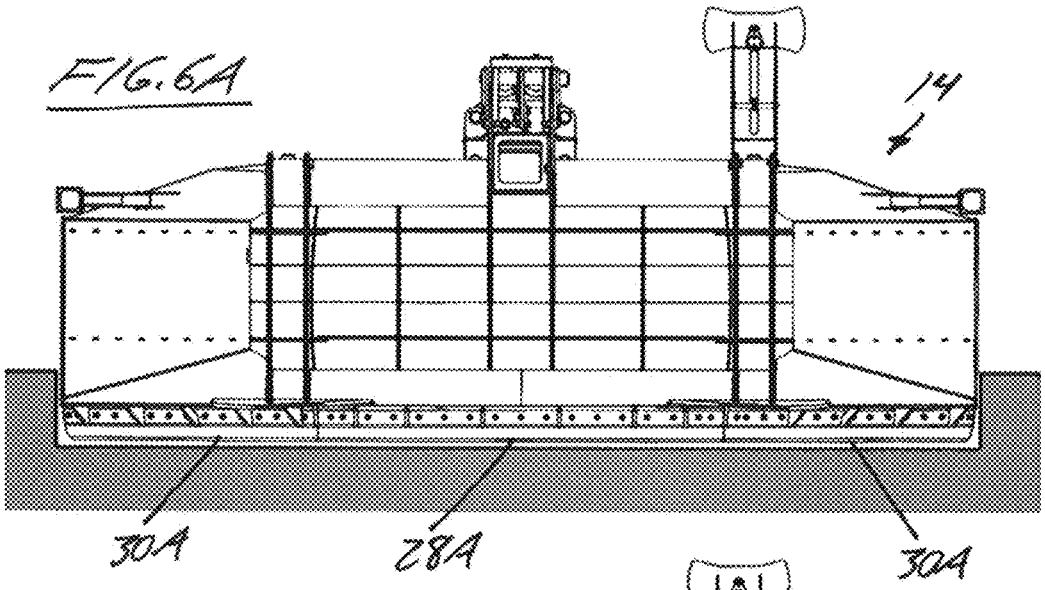
FIG. 6A schematically illustrates working of an earthen surface with the blade assembly of FIG. 5A to create a level ground profile.
Figure 7A:
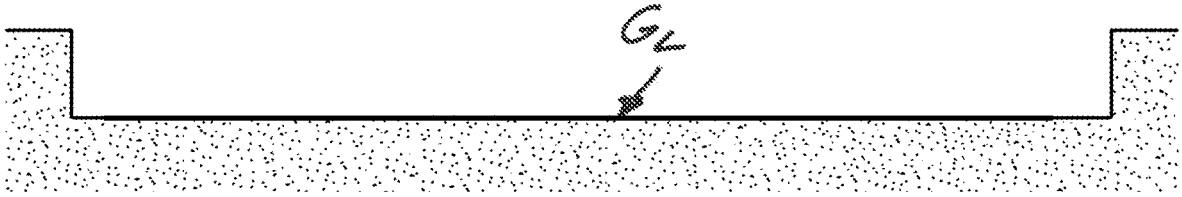
FIG. 7A is an isolated view of the level ground profile resulting from the ground leveling operation performed in FIG. 6A.

In FIG. 4A, the blade-pitch actuators 48 are in neutral positions, and the common plane $P_C$ shared by the bottom working edges 28A, 30A of all three blades 28, 30 is set at an orientation parallel to the ground contact plane $P_G$ of the ground wheels 18. So, in instances where the implement's ground wheels are on a horizontal ground surface, the common plane $P_C$ of the bottom working edges 28A, 30A of the blade assembly 14 is likewise oriented horizontally. With the blade assembly in this pitch-neutral position, and also set at a suitable ground-engaging elevation via adjustment of the frame-tilt actuators 22, the implement is said to be in a ground-levelling mode. As can be seen in the corresponding rear view of the blade assembly in FIG. 5A, the bottom working edges 28A, 30A of all three blades 28, 30 of the blade assembly 14 reside in a same horizontal working plane $P_H$, which during towed use of the implement, schematically shown in FIG. 6A, performs a conventional leveling operation, whereby the ground surface is imparted with a level ground profile $G_L$ over the full width of the blade assembly, the result of which is shown in FIG. 7A.

Figure 4B:
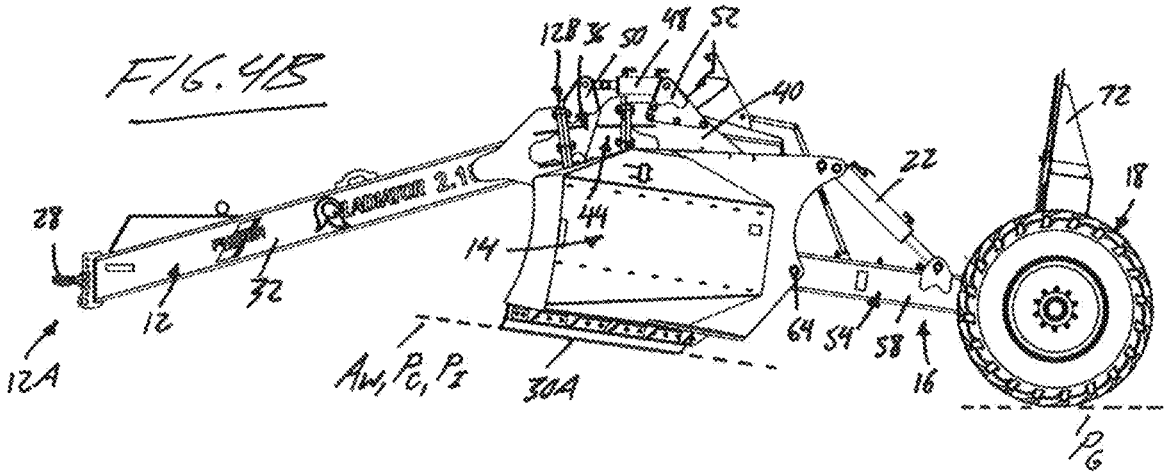
FIG. 4B is a side elevational view of the implement with the blade assembly in a an upwardly pitched position placing the working edges of the wing blades in forwardly inclined relation to the center blade's working edge to perform a ditching operation on the ground surface.
Figure 5B:
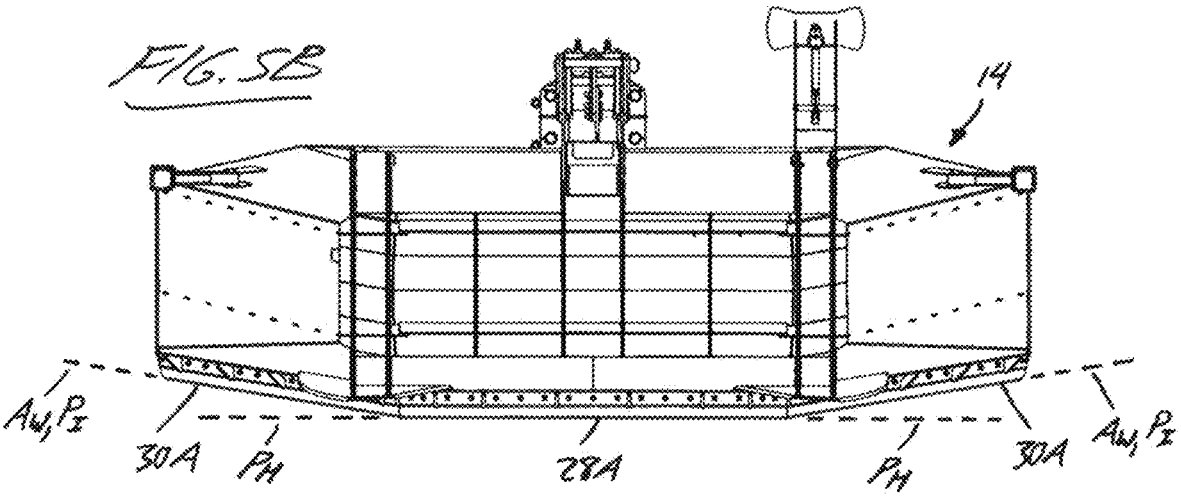
FIG. 5B is a rear elevational view of the blade assembly of the implement in the upwardly pitched position of FIG. 4B.
Figure 6B:
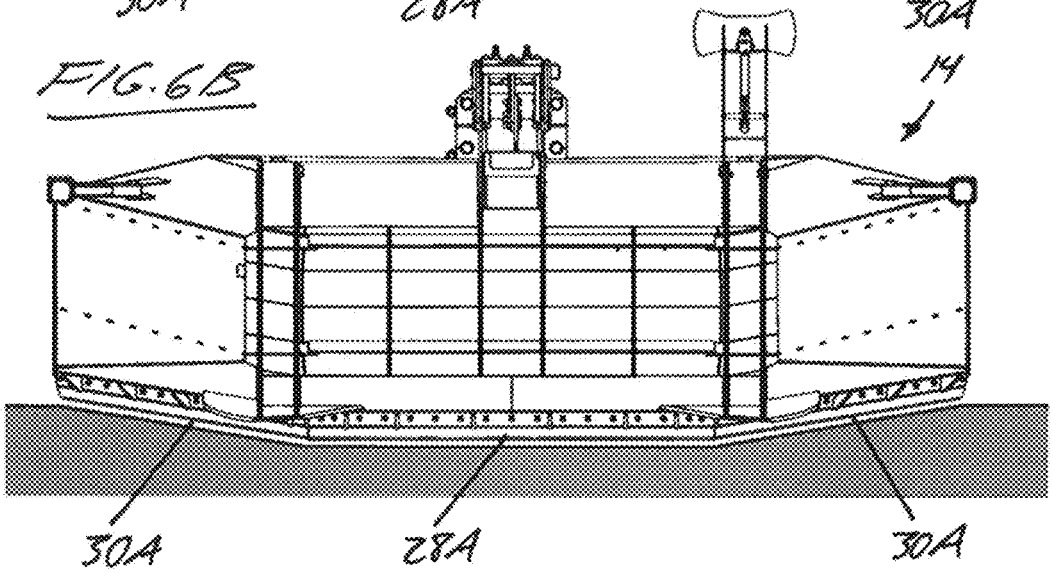
FIG. 6B schematically illustrates working of an earthen surface with the blade assembly of FIG. 5B to create a ditched ground profile.
Figure 7B:
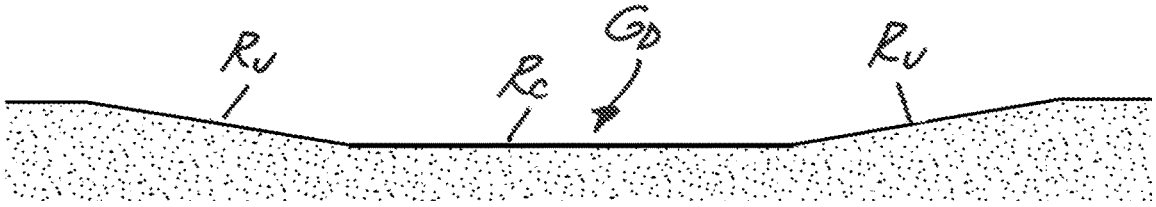
FIG. 7B is an isolated view of the ditched ground profile resulting from the ditching operation performed in FIG. 6B.

In FIG. 4B, the blade-pitch actuators 48 have been extended to pitch the front of the blade assembly 14 upward, a result of which is that the common plane $P_C$ shared by the bottom working edges 28A, 30A of all three blades 28, 30 is set at a forwardly inclined orientation relative to the ground contact plane $P_G$ of the ground wheels 18. So, in instances where the implement's ground wheels are on a horizontal ground surface, the working edge 28A of the center blade 28 once again resides in a horizontal working plane $P_H$, but the working edges 30A of the wing blades 30 reside in forwardly inclined working planes $P_I$ of forwardly inclined relationship to the horizontal working plane $P_H$. While FIG. 4B shows the working edges of the blade assembly in elevated relation to the ground contact plane $P_G$, it will be appreciated that via adjustment of the frame tilt actuators 22, the blade assembly 14 is lowerable down to a suitable working height for engagement with the ground in the manner shown in FIG. 6B. The forwardly inclined slope of these forwardly inclined working planes $P_I$ of the wing blades 30 can be seen in in the side view of FIG. 4B, while laterally-outward angle of inclination also possessed by the forwardly inclined working planes $P_I$ can be seen in the rear blade view of FIG. 5B. With the blade assembly 14 in this upwardly-pitched position, and also set at a suitable ground-engaging elevation, the implement is said to be in a ditching mode. During towed operation of the implement in this ditching mode, as schematically shown in FIG. 6B, a non-uniform ditch-forming ground profile $G_D$ is imparted to the ground surface over the width of the blade assembly 14. With further reference to FIG. 7B, a level central region $R_C$ of the ground profile $G_D$ is formed beneath the horizontal working edge 28A of the center blade 28, and upwardly sloped outer regions $R_U$ of the ground profile GD that slope upwardly from opposing ends of the level central region $R_C$ are respectively formed beneath the outwardly inclined wing blades 30.

Figure 4C:
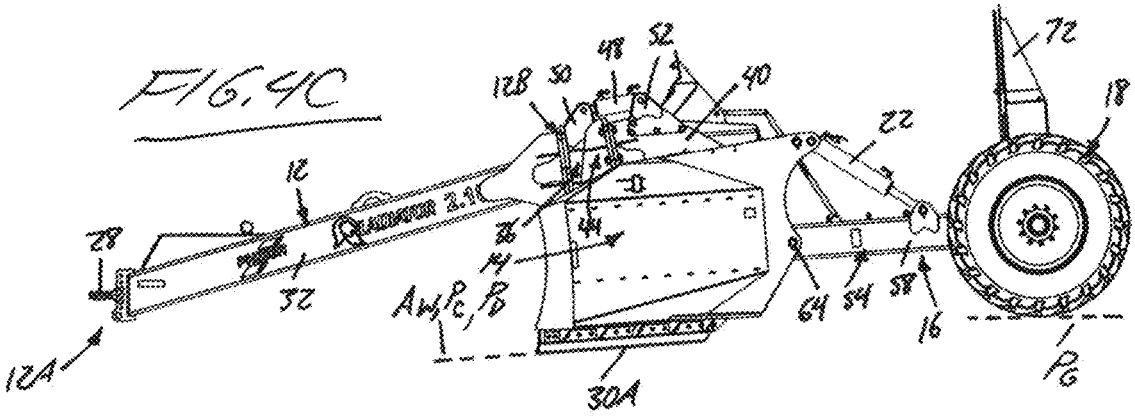
FIG. 4C is a side elevational view of the implement with the blade assembly in an downwardly pitched position placing the working edges of the wing blades in forwardly declined relation to the center blade's working edge to perform a crowning operation on the ground surface.
Figure 5C:
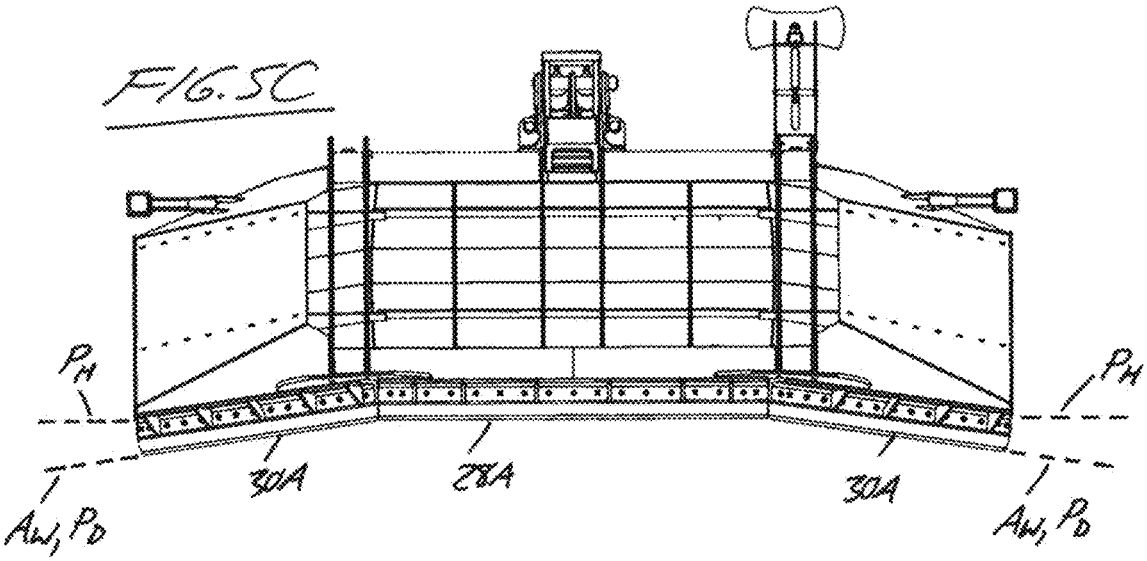
FIG. 5C is a rear elevational view of the blade assembly of the implement in the downwardly pitched position of FIG. 4C.
Figure 6C:
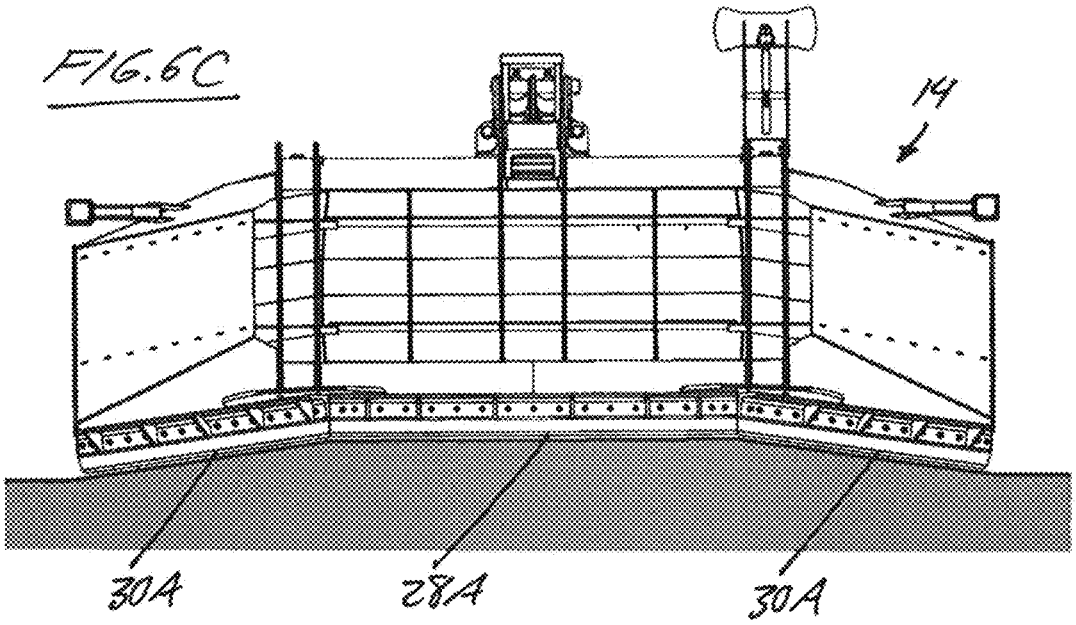
FIG. 6C is schematically illustrates working of an earthen surface with the blade assembly of FIG. 5B to create a crowned ground profile.
Figure 7C:
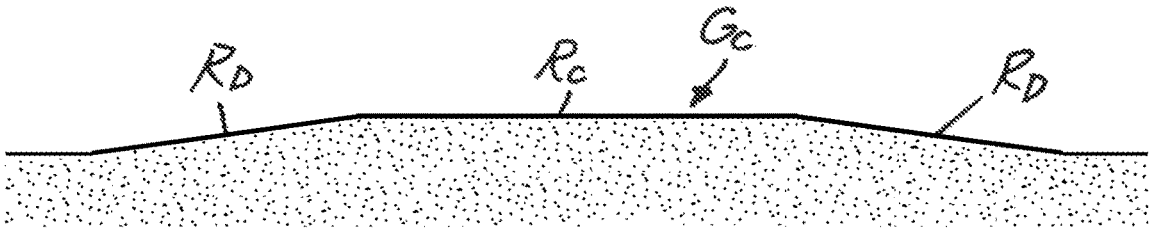
FIG. 7C is an isolated view of the crowned ground profile resulting from the crowing operation performed in FIG. 6C.

In FIG. 4C, the blade-pitch actuators 48 have been collapsed to pitch the front of the blade assembly downward, a result of which is that the common plane $P_C$ shared by the bottom working edges 28A, 30A of all three blades 28, 30 is set at a forwardly declined orientation relative to the ground contact plane $P_G$ of the ground wheels 18. So, in instances where the implement's ground wheels are on a horizontal ground surface, the working edge 28A of the center blade 28 once again resides in a horizontal working plane $P_H$, but the working edges 30A of the wing blades 30 reside declined working planes $P_D$ of forwardly declined relationship to the horizontal working plane $P_H$. The forwardly declined slope of these working planes $P_D$ of the wing blades 30 can be seen in in the side view of FIG. 4C, while a laterally-outward angle of declination also possessed by these forwardly declined working planes $P_D$ can be seen in the rear blade view of FIG. 5C. With the blade assembly 14 in this downwardly-pitched position, and also set at a suitable ground-engaging elevation via adjustment of the frame-tilt actuators 22, the implement is said to be in a crowning mode. During towed operation of the implement in this crowning mode, as schematically shown in FIG. 6C, a non-uniform crown-forming ground profile $G_C$ is imparted to the ground surface over the width of the blade assembly 14. With further reference to FIG. 7C, a level central region $R_C$ of the ground profile $G_C$ is again formed beneath the horizontal working edge 28A of the center blade 28, and downwardly sloped outer regions RD of the ground profile $G_D$ that slope downwardly from opposing ends of the level central region $R_C$ are respectively formed beneath the outwardly declined wing blades 30.

The novel design of the land moving implement thus fully retains the same land levelling and land grading functionality of prior art implements, while adding new ditching and crowning capabilities. In the illustrate embodiment, this extra functionality is attained purely through additional pitch-adjustability of a blade assembly with fixedly-angled wings, rather than through incorporation of movable blade sections by which the shape of the blade assembly itself could be modified to impart different shape profiles to the agricultural field or other ground surface being worked by the towed implement.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A towed earth moving implement comprising:

a pull tongue running in a longitudinal direction and configured at a front end thereof with a coupling arrangement for connection to a tow vehicle for pulling of the implement in the longitudinal direction;

a blade assembly coupled to the pull tongue and comprising:

a center blade lying transversely of the longitudinal direction and spanning laterally outward from the pull tongue each of two opposing sides thereof; and a pair of wing blades connected to the center blade at opposing ends thereof on the two opposing sides of the pull tongue and each being oriented in non-parallel relation to the central blade in an orientation angling both forwardly and laterally outward therefrom; and a wheeled frame on which the blade assembly is carried for rolling travel over an earthen surface workable by the blade assembly;

a pivotal blade-pitch connection between the pull tongue and the blade assembly that defines a blade pitch axis lying transversely of the longitudinal direction, the pivotal blade-pitch connection residing in front of the central blade, and thus in leading relation thereto during towed conveyance of the implement by the tow vehicle;

at least one blade-pitch actuator operable to adjust a pitch angle of the blade, relative to the pull tongue, about the blade pitch axis;

wherein each of the center and wing blades has a respective bottom working edge, and the blade assembly is movable between at least two of the following three operational positions, in each of which the respective bottom working edge of the center blade resides in a horizontal working plane;

a pitch-neutral levelling position in which the respective bottom working edges of the wing blades both reside in the same horizontal working plane as the respective working edge of the center blade;

an upwardly pitched ditching position in which the respective bottom working edges of the wing blades reside in forwardly inclined working planes of forwardly inclined relation to the horizontal working plane; and a downwardly-pitched crowning position in which the respective bottom working edges of the wing blades reside in forwardly decline working planes of forwardly declined relation to the horizontal reference plane.

2. The implement of claim 1 further comprising a pivotal frame-tilt connection between the wheeled frame and the blade assembly that defines a frame-tilt axis lying transversely of the longitudinal direction, and at least one frame-tilt actuator operable to adjust a relative angle between the wheeled frame and the blade assembly about the frame-tilt axis.

3. The implement of claim 1 wherein the wheeled frame comprises a blade-carrying subframe on which the blade is carried, and a wheel-carrying subframe on which one or more wheels are mounted, and the implement further comprises a swivel connection between the blade-carrying and wheel-carrying subframes that defines a longitudinally oriented roll axis, and at least one frame-swivel actuator operable to adjust a relative roll angle between the blade-carrying and wheel-carrying subframes about the roll axis.

4. The implement of claim 1 wherein each wing blade is fixed at an oblique orientation relative to the center blade.

5. The implement of claim 1 wherein the blade assembly is movable between at least the pitch-neutral levelling position and the upwardly-pitched ditching position.

6. The implement of claim 1 wherein the blade assembly is movable between at least the pitch-neutral levelling position and the downwardly-pitched crowning position.

7. The implement of claim 1 wherein the blade assembly is movable between at least the downwardly-pitched crowning position and the upwardly-pitched ditching position.

8. The implement of claim 1 wherein the blade assembly is movable between all three operational positions.

9. The implement of claim 1 comprising a longitudinally oriented neck fixed atop the blade assembly, a front end of which resides forwardly of the center blade, in leading relation thereto, and hosts the pivotal blade-pitch connection.

10. The implement of claim 9 wherein the pivotal blade-pitch connection comprises a pair of knuckles pivotally mated together at the blade-pitch axis, one of which is fixed to the neck at the front end thereof, and another of which is fixed to the pull tongue at a rear end thereof.

11. The implement of claim 9 wherein the at least one blade-pitch actuator is pivotally mounted atop the neck.

12. The implement of claim 10 comprising a mounting flange that terminates a respective one of either the pull tongue or the neck, and a respective one of the knuckles is attached to the mounting flange.

13. The implement of claim 12 wherein the mounting flange terminates the neck at the front end thereof.

14. The implement of claim 12 wherein the mounting flange terminates the pull tongue at the rear end thereof.

15. The implement of claim 10 wherein both the neck and the pull tongue each terminate in a respective mounting flange to which a respective one of the knuckles is mounted.

16. The implement of claim 9 wherein the blade assembly comprises an upper hood spanning forwardly from a top of the center blade and spanning laterally between the wing blades, and the neck is mounted atop the upper hood of the blade assembly.

17. The implement of 1 wherein the blade assembly comprises an upper hood spanning forwardly from a top of the center blade and spanning laterally between the wing blades.

* * * * *